United States Patent [19]

Velte

[11] Patent Number: 5,046,349

[45] Date of Patent: Sep. 10, 1991

[54] EXPANSION TOOL FOR HOLLOW WORKING PARTS

[75] Inventor: Karl-Heinz Velte, Weilrod, Fed. Rep. of Germany

[73] Assignee: Rothenberger Werkzeuge-Maschinen GmbH, Frankfurt am Main, Fed. Rep. of Germany

[21] Appl. No.: 581,569

[22] Filed: Sep. 12, 1990

[30] Foreign Application Priority Data

Sep. 14, 1989 [DE] Fed. Rep. of Germany ..... 3930710
May 30, 1990 [DE] Fed. Rep. of Germany ..... 4017404

[51] Int. Cl.[5] ..... B21D 41/02
[52] U.S. Cl. ..... 72/393; 72/452
[58] Field of Search ..... 72/393, 452; 74/107

[56] References Cited

U.S. PATENT DOCUMENTS 720,322 2/1903 Burkholder ..... 74/107
3,052,828 9/1962 Phinizy ..... 74/107
4,890,472 1/1990 Rothenberger ..... 72/393

FOREIGN PATENT DOCUMENTS 8800503 1/1988 PCT Int'l Appl. .
866994 5/1961 United Kingdom .
2098529 11/1982 United Kingdom .

*Primary Examiner*—Lowell A. Larson
*Attorney, Agent, or Firm*—Felfe & Lynch

[57] ABSTRACT

An expansion tool (1) for pipes with a basic tool body (2) includes two hand levers (3, 12), one of which (12) operates an expanding mandrel (5) with a free rotating cylinder (19) through a control mechanism (10). By activating the lever, the expanding mandrel emerges from the basic body (2) sliding at a preset stroke against a set (15) of radially moving expanding wedges (16). In order to allow the enforced withdrawal of the expanding mandrel (5) with reduced operating forces and a specific force distribution, the cylinder (19) is journaled on a cylinder pin (19*a*). The expanding mandrel is connected to the movable hand lever (12) through a retraction device (20). In one form of construction with a cam shaped control mechanism (10), the retraction device (29) consists of a tension member with working points on the cylinder (19) and on the hand lever (12). In another form of construction the control mechanism has a slot running in a curve around its swivel axis, in which slot the cylinder is guided in both directions of the movement of the expanding mandrel.

16 Claims, 5 Drawing Sheets

FIG. 4
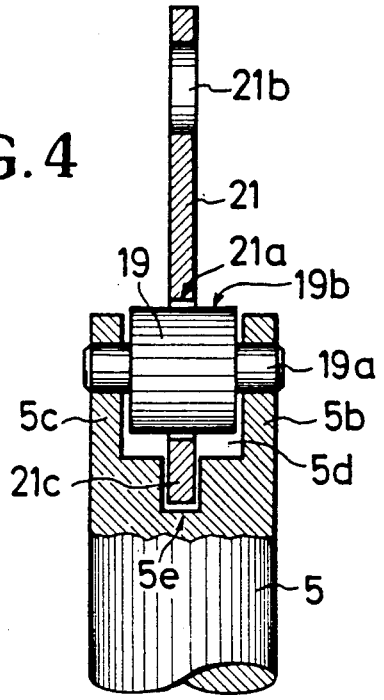
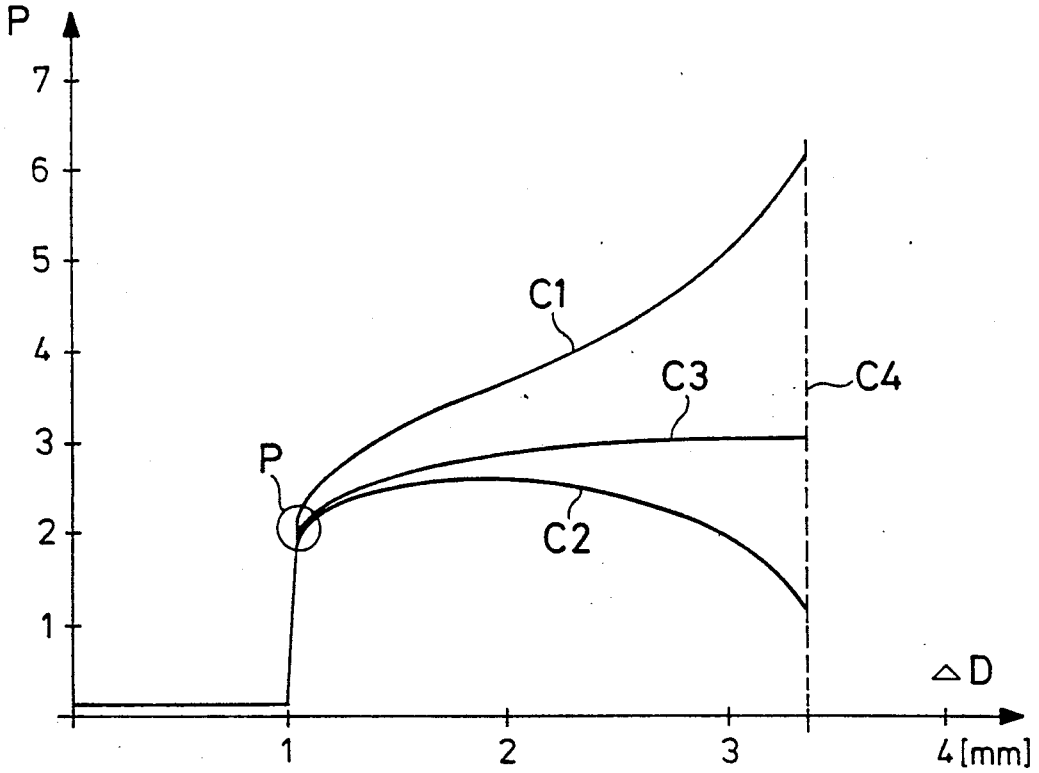
FIG. 5

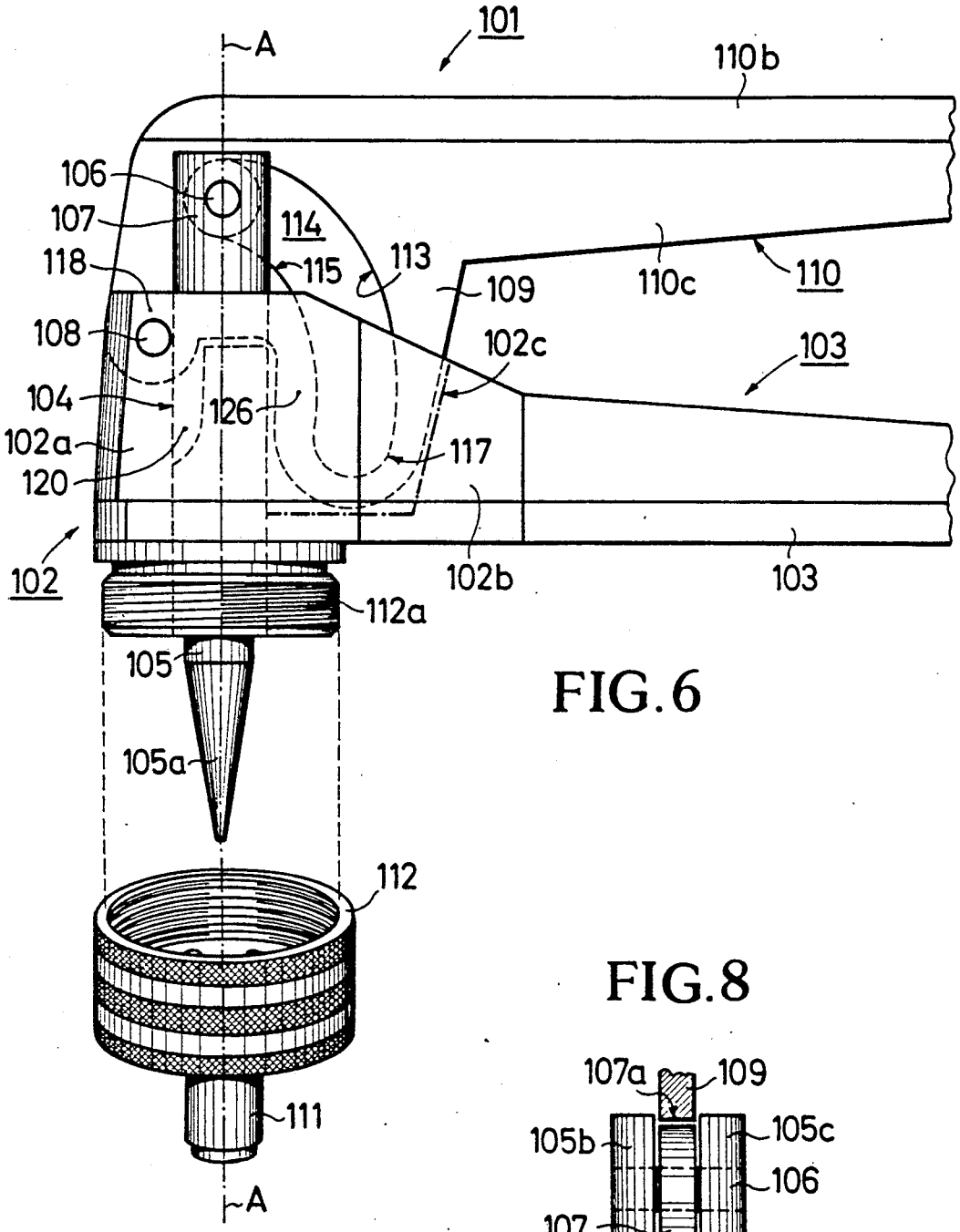
FIG.6
FIG.8
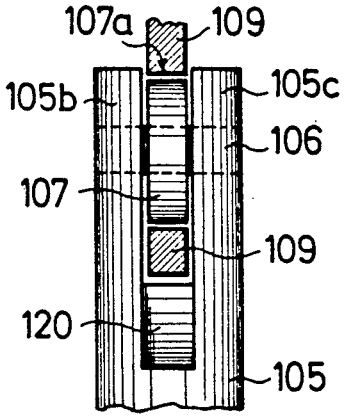

EXPANSION TOOL FOR HOLLOW WORKING PARTS

BACKGROUND OF THE INVENTION

The invention concerns an expansion tool for hollow, in particular hollow cylindrical working parts with a basic tool body and a borehole, and an expanding mandrel located in this borehole in an axially slidable position and having an exterior tapered end protruding from the borehole. A swivelling control device also located in the basic tool body which acts on the expanding mandrel through a free rotating cylinder has an axis perpenicular to the borehole axis, and is connected to a hand lever which, when activated, causes the expanding mandrel to emerge from the basic body (2), sliding at a preset stroke against a set (15) of radially moving expanding wedges.

These types of expanding tools are also called "Expanders". They are used like tongs, i.e. the swivel hand lever has a second hand lever of the same length, which is rigidly connected to the basic body. Expanders are mainly used to expand the ends of pipes to the extent necessary to allow the introduction of a second, non expanded pipe end into the expanded area, and to weld it to the first pipe end. It is used in construction sites and in workshops.

The operating forces are determined by the transmission ratio in the operating system of the expanding mandrel, by the friction ratio between all the movable parts and—not least—by the flow of the material of the working part to be expanded. The following materials are suitable: plastic pipes, thin walled soft steel pipes, but mainly copper pipes, annealed as well as so called "hard" copper pipes. These tools are preponderantly used in the construction of pipes, particularly in the sanitary and installation fields.

In view of the ergonomic relations, it should be noted that the angle of traverse of both hand levers in relation to each other, taking into account the transmission ratio, is slightly over 90 degrees. Since in this situation the actual power stroke occurs relatively early, the two hand levers are at a relatively unfavourable position to each other at the start of the power stroke. Since normally the basic tool body cannot be supported anywhere, the effective operating forces can only run parallel to the axis of the expanding mandrel; all other reaction forces must be additionally absorbed by the person operating the device. For instance, it is not possible at the beginning of the power stroke to load the hand levers running radially in relation to the swivel axis of one of the hand levers, in a purely tangential direction (then the operator would pull the basic tool body towards himself), instead purely paraxial forces must be applied. Mechanically this is expressed in such form, that the effective length of the hand levers, which at this point form a 90 degree angle, is drastically shortened. The ratios do improve as the hand levers approach each other, which to a certain extent compensates for the increasing deformation forces during the expanding procedure, but depending on the chosen type of operation, can also cause the operating forces to drop off drastically towards the end of the power stroke, leaving the operator without any "feel" regarding which forces and reaction forces are released inside the operating system.

In the course of the development of this type of tong like expanders, the following operating systems were created:

In the expander according to GB-PS 866 994 (Rast) an eccentrically positioned cam acts directly on the bevelled back of the expanding mandrel. This causes the development of tangential power components in relation to the cam curve, and radial components in relation to the expanding mandrel, which press the expanding mandrel against its bearing, thus also producing together with the increasing deformation forces of the working part, increased sluggishness. The expanding mandrel becomes in a way the brake shoe for the cam, so that the operating forces progressively increase during the expanding procedure. Another disadvantage of this operating system resides in the fact that the expanding mandrel cannot be retracted. Since the return springs of the expanding wedges act as an automatic lock opposite the expanding mandrel, the expanding wedges with their control surfaces, which can be seen as cone sectors, cannot produce the retraction of the expanding mandrel. In the case of shrinking working parts, as is the case during the expanding of plastic pipes, this kind of expander cannot be easily dislodged from the pipe.

In a further development of this operating principle according to GB-PS 1 485 098 (Rothenberger), the power requirements for the axial sliding of the expanding mandrel were reduced by flattening the course of the curve of the cam, and the full stroke of the expanding mandrel was attained by operating the cam repeatedly and adjusting it after each stroke. For this purpose the cam axis is placed in two cranks with axially staggered recesses. However, the force economy due to the changed transmission ratio and the resulting lengthening of the operating path, was very limited because the braking effect of the expanding mandrel on the cam surface remained practically unchanged. With this known system an enforced withdrawal of the expanding mandrel was absolutely impossible, since traction could neither be applied on the hand lever nor on the cam because of the connecting link guide. A compression spring placed between the expanding mandrel and the basic tool body was only able to produce a certain arresting effect on the connecting link guide, but not the enforced withdrawal of the expanding mandrel. U.S. Pat. No. 4,890,472 discloses an expander which makes possible the enforced withdrawal of the expanding mandrel, and with it a return of the expanding wedges to the starting position, possible thanks to a tension member between the expanding mandrel and the hand lever. However, the high driving forces remained the same as in the expander according to GB-PS 866 994.

In the operating system according to U.S. Pat. No. 4 425 783 the friction forces between the cam and the expanding mandrel on one hand, and the expanding mandrel and its drive (borehole) on the other hand are eliminated to a large extent, although without providing the means for the enforced withdrawal of the expanding mandrel. This is accomplished by placing a swivelling hammer shaped compression member between the expanding mandrel and the cam, since the course of the curve of the cam, and of the surface of the compression member which rolls over it, is such that the axis of the expanding mandrel always intersects the common line of contact of the cam and the compression member. IN order to always start from the same initial position of the compression member, the latter has a return spring.

However, when the power stroke is interrupted, the compression member falls back under the effect of the return spring, and the prior existing correlation between cam and compression member no longer exists. However, because of the complicated bearing of the cams and the hand levers, this known system creates friction forces in another place, namely on the perimeter of two relatively large circular disks with which the hand levers and the cams are mounted in the basic tool body. In this case the basic tool body acts, opposite the above mentioned circular disks, as a braking device under the influence of the axial operating forces.

An operating system is known according to U.S. Pat. No. 4,735,078 in which low driving forces are paired with the enforced withdrawal of the expanding mandrel. This is accomplished by placing an elbow lever between the hand lever, which does not have a cam, and the expanding mandrel. This example has a disadvantage compared to the Expander according to U.S. Pat. No. 4,425,783, namely that on one hand the slanted position of the elbow lever at the start of the working stroke creates transverse force components which act on the expanding mandrel, increasing the friction between the expanding mandrel and its bearing (borehole), on the other hand the elbow lever drive has the particularity that the output forces created thereby go towards infinity when the driven parts hit a stroke while all links of the elbow lever system are completely stretched. If tolerances fall below normal values, particularly tolerances in the accessory parts which usually include several sets of expanding wedges of different diameters, an overstrain can occur which the operator would not notice because there is no corresponding increase in the operating force. Experience has shown that with the use of an elbow lever drive in an expander, the force requirements at the end of the working stroke are practically zero, i.e. the hand levers can be put together, almost without requiring any force. Consequently the operator loses any "feel" for the expanding procedure. Usually elbow lever presses are equipped with overload clutches in order to prevent an overload when all three elbow lever links are stretched, and consequently avoid the destruction of the system. The installation of overload clutches is however not possible in the case of hand tools for space and weight reasons.

An expansion tool of the type described at the beginning is known through patent DE-GM 88 07 784 (WO 88/00503), in which the free rotating cylinder consists of a roller whose cylinder surface, the so called rolling surface for the control mechanism, is placed in a complementary recess which runs transversally to the axis of the expanding mandrel. But this reduces the friction between the cam and the expanding mandrel only negligibly, because the roller slides in its recess with the cylinder surface, i.e. with the same diameter on which also the cam surface rolls. This merely causes the shifting of the friction and braking forces to another place, or the cam will slide on the stationary surface of the roller even in case of a slight slow down. Such a mechanical system is also called "indifferent". It does not produce any changes in the friction and in the transversal forces.

SUMMARY OF THE INVENTION

The purpose of the invention is to create an expansion tool of the type described above, i.e. one with a control mechanism in the operating system in which the friction forces are reduced to a minimum, the expanding mandrel withdraws, the operating forces remain constant to a large extent over the entire period of the working stroke, so that the operator has a "feel" for the proper development of the expanding procedure, and in which an overload cannot occur, even in an unfavourable tolerance situation.

According to the invention, the freely rotating cylinder or roller (member having a cylindrical surface) is journaled on a coaxial cylinder pin and the expanding mandrel has two side walls defining a channel in its inner end. The roller is mounted in the channel on the cylinder pin, which is fixed in the sidewalls. A withdrawing device is placed between the expanding mandrel and the hand lever.

This type of roller is always operational, and in contrast to the expander according to U.S. Pat. No. 4 425 783 it also does not lose its efficacy should the expansion stroke be interrupted. A roller also does not require a return spring.

The friction forces are thus reduced to a minimum compared to U.S. Pat. No. 4,425,783, because the link pins, and with it the mounting areas have a relatively small diameter, and further because the contact line between the cam surface and the cylinder surface of the roller is always located on, or at least in close proximity, of the axis of the expanding mandrel.

Compared to DE-GM 88 07 784 the friction forces are reduced because the roller pin has a smaller diameter compared to the cylinder surface of the roller, so that equal compression forces acting axially on the expanding mandrel produce a distinctly lesser counter torque or braking couple. Consequently, no transverse forces or at least no noticeable transverse forces act on the expanding mandrel.

Furthermore, the withdrawal device for the retraction of the expanding mandrel is easily integrated into the operating system. In the first form of construction the withdrawal device consisted of a tension member in the form of a rigid tongue, which can be made of a relatively thin metal plate, and can be placed in a narrow slit of the control mechanism, since it is not exposed to pressure. The tension member also prevents in a very simple fashion the twisting of the expanding mandrel in relation to the cam, without requiring a special slaving guide for the expanding mandrel in the basic tool body.

With the corresponding course of the control curve in relation to the axis one can also easily achieve an operating force that remains constant to a large extent over almost the entire angle of traverse of the hand lever, but at least over the last portion of the field of traverse, thus giving the operator the feeling that the expanding procedure is being completed. Finally, the overload of the components of the entire expansion tool is rendered impossible, since the contact between movable parts and stationary parts manifests itself immediately in an increase of the operating force, thus informing the operator that the expanding procedure has been completed.

Because of the play of the tongue in longitudinal direction, it is possible to avoid exerting pressure on the tongue at any point during the expanding procedure. However, the tongue pin is placed in such a fashion in a slot in the tongue, that the expanding mandrel retracts immediately when the hand lever is swung back. Because the tongue embraces the roll in its outer perimeter, the roll axis cannot twist opposite the tongue and the tension member.

Therefore, it is a particular advantage, if the recess of the control mechanism is located in the middle, and has side walls running parallel to the side walls of the control mechanism located in the basic tool body, the other end of the tongue has a cylindrical borehole surrounding the roller in its axial middle, and when the tongue has an extension beyond the borehole placed in the parallel slot of the expanding mandrel, and the mentioned slot opens out into the channel which houses the roller.

Finally, it is particularly advantageous if the swivel axis of the control mechanism and the roller axis intersect the borehole axis. In this case practically only forces parallel to the axis are created within the system, so that friction forces and wear between the expanding mandrel and the borehole in the basic tool body are avoided.

Another form of construction of the object of the invention has the same roller placement but is characterized by the fact that:

the control mechanism has a curved slot running about its swivel axis, whose ends are at different distances from the swivel axis in accordance with the stroke of the expanding mandrel, and whose internal width corresponds to the diameter of the roller, and in which the roller slides in both directions of the movement of the expanding mandrel, and the control mechanism is placed at least partially between both side walls of the expanding mandrel.

In a sturdy construction, the curved surface of the slot (or the curved part of the control mechanism) nearest to the swivel axis of the control mechanism can embrace the roller from behind, allowing the expanding mandrel to guide in both axial directions, i.e. also into the enforced withdrawal position.

The control mechanism, which can be a stamped metal part made of a steel plate or can be forged as a single part together with the hand lever, requiring only little finishing on the surface of the slot, serves at the same time as a guiding element for the expanding mandrel and prevents the latter from twisting. It is understood that the thickness oft he control mechanism corresponds, at least in certain parts, to the internal distance of the side walls of the expanding mandrel.

It is specially advantageous, if the ends of the curved slot form stops in order to limit the angle of traverse of the swivelling hand lever, i.e. the curve arch of the slot is limited in a defined manner. This accomplishes two things: Firstly one stop limits the approximation of the hand levers to a minimum distance in order to prevent a crushing of the fingers, secondly the operating force of the hand lever at the end of the expanding procedure is also defined.

It is specially easy to make the course of the curved slot such that, in relation to the swivel axis of the control mechanism and to the roller, the operating force on the movable hand lever remains essentially constant over the last 20 degrees of the angle of traverse of the hand lever.

With regards to the assembly and manufacture, the size, the weight and the torsional rigidity of the movable hand lever in relation to the basic tool body, it is of particular advantage if the control mechanism forms one end of the swivelling hand lever, and has an eyelet through which the swivel pin passes, which pin penetrates a channel in the basic body, and is located laterally in same, outside the expanding mandrel, opposite the hand levers on both sides of the channel in the basic body.

Material costs and weight can also be positively influenced if the control mechanism is built in the form of a plate shaped component, and is placed in a channel with parallel walls in the movable hand lever. This for instance allows a construction in which the basic tool body and both hand levers are made of a light alloy, but the control mechanism is made of steel.

A particularly durable expansion tool which has a basic tool body with a thread, placed in a known manner concentrically to the expanding mandrel, and to which the set of expanding wedges can be screwed by means of a threaded sleeve, can be manufactured if the thread is mounted on the outer surface of a connecting piece, which is connected to the basic tool body by means of a hollow cylindrical extension, and when the continuous borehole of the connecting piece and the extension form the axial guide way for the expanding mandrel.

BRIEF DESCRIPTION OF THE DRAWINGS

FIG. 4 is an enlarged partial detail of FIG. 1 in a sectional plane vertical to the drawing plane along the axis A—A;

FIG. 5 is a diagram with a comparative representation of the operating forces according to the prior art, and according to the present invention;

FIG. 6 shows a second form of construction, a lateral view of essential parts of the expanding apparatus at the end of the expanding procedure, i.e. with hand levers joined to a maximum, together with a representation in perspective of an unscrewed set of expanding wedges;

FIG. 8 the upper end of the expanding mandrel with roller, rotated by 90 degrees opposite FIG. 7, and on an enlarged scale, and FIG. 9 a top view of essential parts of a third form of construction with a steel control mechanism mounted in a hand lever of light metal.

DETAILED DESCRIPTION OF THE PREFERRED EMBODIMENTS

Figure 1:
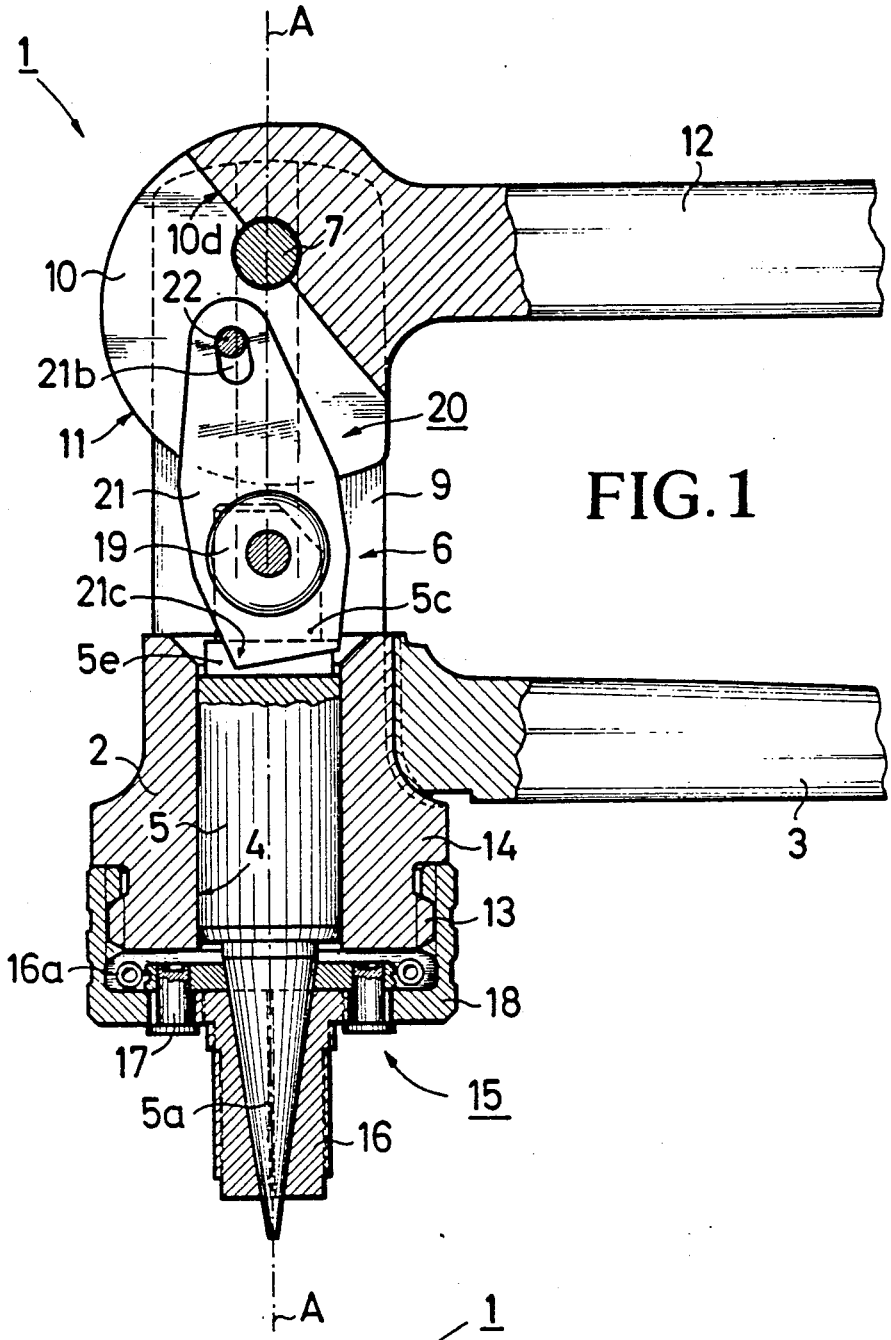
FIG. 1 shows a first form of construction, an axial partial section of the basic tool body with all essential operating parts.
Figure 2:
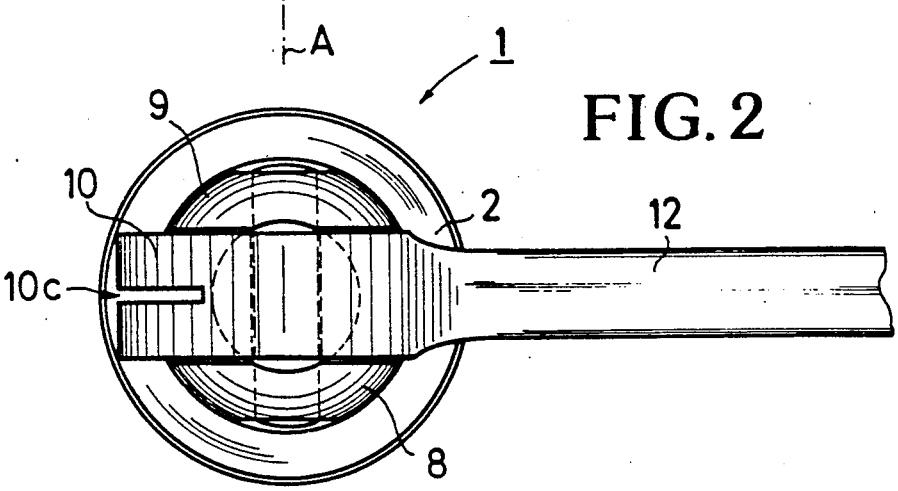
FIG. 2 is a top view from above the object in FIG. 1.

FIGS. 1 to 4 show an expansion tool 1 with a basic tool body 2, originally built as a swivel, to which a radially projecting first hand lever 3 is fixed. The basic tool body 2 has an axis A—A and a borehole 4 concentric to the axis, in which is mounted an expanding mandrel 5 which slides in axial direction, and whose one end 5*a* is conically tapered and protrudes from the basic tool body 2.

The end facing away from the end 5*a* of the expanding mandrel has a channel 6 with parallel walls 8, 9 above the hand lever 3, into which opens the borehole 4. The walls form the bearing block for a control mechanism 10 in the form of a cam.

This control mechanism 10 has a borehole 10*a* which receives a swivel pin 7, placed in the channel 6, in which the axis of the swivel pin 7 runs perpendicular to the axis A—A, intersecting same. The control mechanism 10 has a cam 11 running eccentrically to the pin 7 and the borehole 10*a*, which acts on the expanding mandrel 5 in a fashion which will be described in more detail below.

The control mechanism 10 is connected to a second hand lever 12 forming one single piece, which protrudes laterally from the channel 6. Both hand levers 3 and 12 have handles on their ends, not shown here, so that both hand levers can be used like tongs in relation to the basic tool body 2. FIG. 1 shows both hand levers 3 and 12 in its closest position. It can however be seen, that the second hand lever 12 can be swung counterclockwise in an angle of traverse of more than 90 degrees, i.e. beyond the axis A—A, from its starting position shown in the drawing. The cam 11 has a geometric form in relation to the pin 7, which allows the optimal flow of the working part and the optimal development of the operating forces as a function of the angle position of the hand lever 12, also allowing the operating force on the hand lever 12 to remain constant over the last 20 degrees of the angle of traverse. This type of course of forces is shown in FIG. 5 in the middle curve.

The basic tool body 2 has on the end facing the end 5*a* of the expanding mandrel 5, a thread 13 and a ring shoulder 14 for the mounting of a set 15 of single expanding wedges 16, which are distributed on the circumference of the expanding mandrel 5. The expanding wedges 16 can be slid in radial direction by means of rivets 17, and are guided and supported in the inside facing flange of a screw cap 18, which is screwed to the thread 13 against the ring shoulder 14. FIG. 1 shows that the set 15 of expanding wedges 16 can be pushed to the outside radially, by inserting the conically shaped end 5*a* into the expanding wedges 16. The retraction is accomplished with an annular spring 16*a* which, however, due to the existing automatic locking cannot displace the expanding mandrel 5.

The expanding mandrel has in its inner end two side walls 5*b* and 5*c*, which enclose a channel 5*d*, located in the middle with parallel surfaces. In this channel a cylinder 19 has been placed by means of a cylinder axis 19*a* in a free rotating position;, the cylinder pin 19*a* of the cylinder 19 runs parallel to the pin 7. The cylinder surface 19*b* of the cylinder 19 protrudes from the channel 5*d* only towards the top, and sideways in the direction of the hand lever 12, as shown in FIGS. 1 and 4. This way the cylinder 19 can roll on the cam 11 of the control mechanism 10 (FIG. 1). However, the cylinder surface 19*b* does not touch parts of the surface of the expanding mandrel 5. The cylinder 19 in the expanding mandrel is only supported by the cylinder pin 19*a*.

Figure 3:
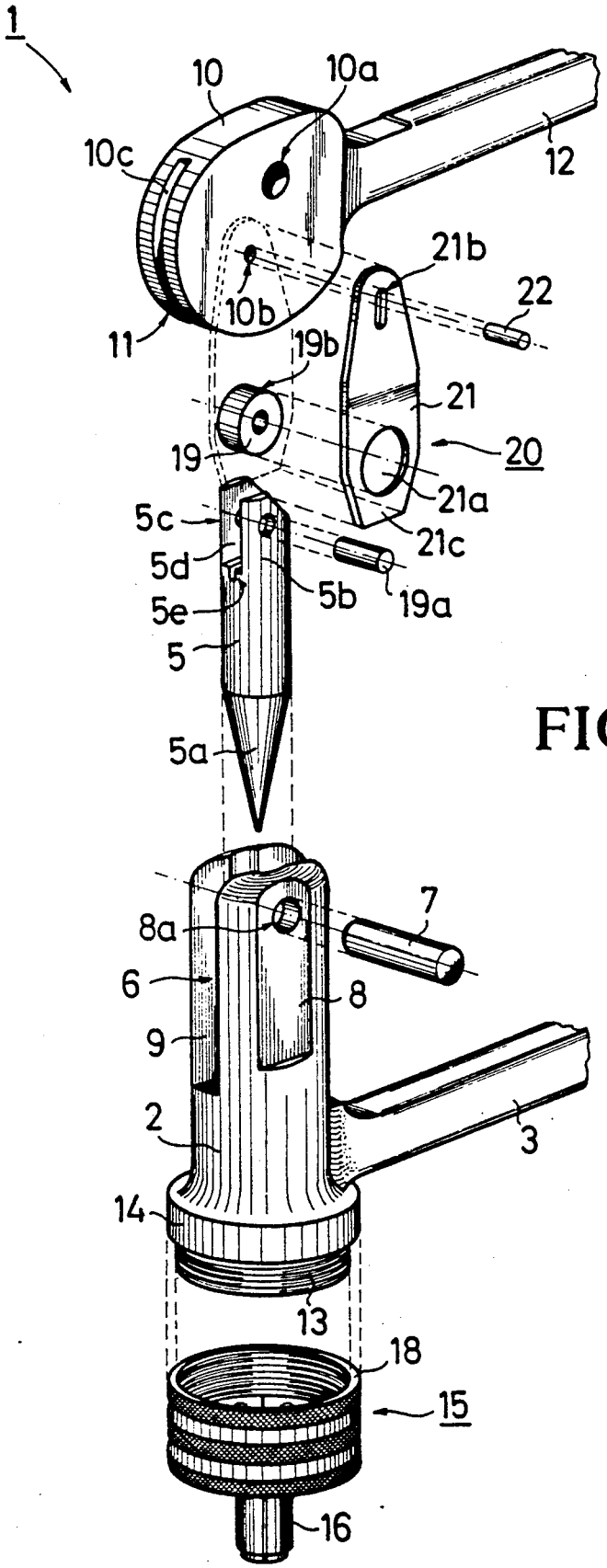
FIG. 3 is an explosed perspective view of the expansion tool according to FIG. 1.

A withdrawal device 20 is mounted between the expanding mandrel 5 and the hand lever 12 for the enforced withdrawal of the expanding mandrel from the expanding wedges; the expanding mandrel 5 is connected to the control mechanism 10, and also with the hand lever 12 by means of a rigid tongue 21. The rigid tongue consists of a plate from sheet metal with parallel faces, with a cylindrical borehole 21*a* on one end, and a slot 21*b* on the other end. The tongue 21 is connected to the control mechanism 10 through the slot 21*b* with a tongue pin 22. The tongue 21 surrounds the cylinder 19 in its axial middle by means of the cylindrical borehole 21*a*. The tongue 21 has an extension 21*c* beyond and underneath the borehole 21*a*, which engages into the channel 5*e* with parallel walls in the expanding mandrel 5. This occurs with the least possible play, in order to prevent the twisting of the expanding mandrel 5 with the cylinder 19 in relation, to the tongue 21. The slit 5*e* opens into the middle of the channel 5*d* in which the cylinder 19 is mounted (FIG. 1, in connection with FIG. 4 in particular). The extension 21*c* can realize swivelling and longitudinal movements inside channel 5*e*. The control mechanism 10 has a borehole 10*a*, in which the axis 7 is placed, when the device is assembled. Both ends of axis 7 are placed in two aligned boreholes in both side cheeks 8 and 9. FIG. 3 shows only one of the boreholes 8*a*.

The control mechanism 10 also has a borehole 10*b*, which runs eccentrically to the borehole 10*a*, and in which the tongue pin 22 is placed, when the device is assembled. More specifically, the borehole 10*b* is interrupted in the middle by a slit shaped recess 10*c*, into which the upper end of the tongue 21 is mounted in a manner that protects against torsion. The side walls of the recess 10*c* run parallel to each other, and parallel to the side walls of the control mechanism 10, guided in the basic tool body 2 by means of the side walls 8 and 9. The width of the recess 10*c* is only slightly larger than the thickness of the tongue 21.

FIG. 1 in particular shows that the slit shaped recess 10*c* has such a circumference in relation to pin 7, that the base 10*d* of the recess 10*c* cannot touch the tongue 21 in any possible position of the hand lever 12.

FIG. 5 shows a diagram in which the difference in pipe diameter ΔD, and the double expansion path is shown in millimeters on the abscissa, and on the ordinate the operating force between the two hand levers 3 and 12 is shown in dimensionless units. The reason for using dimensionless units on the ordinate is because the operating force naturally depends on the diameter to be expanded, the wall thickness, and the deformation characteristics of the working part. The first millimeter path in the diameter expansion of the expanding wedges occurs in the so called idle stroke. In this case only reduced friction forces have to be overcome in the system. The working part is then deformed elastically up to a point P, followed by a plastic deformation of the working part until the part has reached the final diameter (dotted line). The slight spring-back after releasing the working part should be disregarded.

The upper curve C1 shows the force distribution in an expansion tool, in which the cam 11 glides on the inner blunt end of the expanding mandrel. It can be clearly seen, that the force requirement increases progressively to a very high final value.

The lower curve C2 shows the force distribution in an elbow lever expander, and it is clearly visible that the force requirement after exceeding a maximum value, drops drastically to a very low value. This decrease of the operating force, however, does not imply a decrease of the forces in the system. Quite the contrary is the case: since the stretched position of the links of the elbow lever are reached in the area of the dotted line, the forces necessarily increase to the infinite value, provided there is a corresponding counteracting force, which for instance could also occur unintentionally due to a too low tolerance.

The middle curve C3 describes the force distribution in the operating system of the invention, and it is clearly visible that the operating forces remain essentially constant, at least in the last portion of the expansion path of the part. If during this process any parts touch each other inside the operating system, a sudden force increase occurs in the direction of the curve section C4, i.e. the operator immediately receives a signal informing him that that part cannot be expanded any further.

It is of course possible to impart to the control mechanism or the cam 11 a course that will cause the operating forces to decrease drastically towards the end of the procedure. This for instance would be the case if the cam 11 were of almost constant radius about pin 7, in the section that is processed last. But on the other hand it is only possible to decrease the force requirements in an operating system according to curve C1 or to increase the force requirements correspondingly in an elbow lever system according to curve C2. An elbow lever system has the unavoidable characteristic that the output forces go towards infinity when all link axles are stretched, while the operating forces simultaneously practically drop to zero. The fact that the operating forces can be influenced is also the main reason why the known cam drive of the expanding mandrel has maintained its position on the market for decades.

Figures 7, 9:
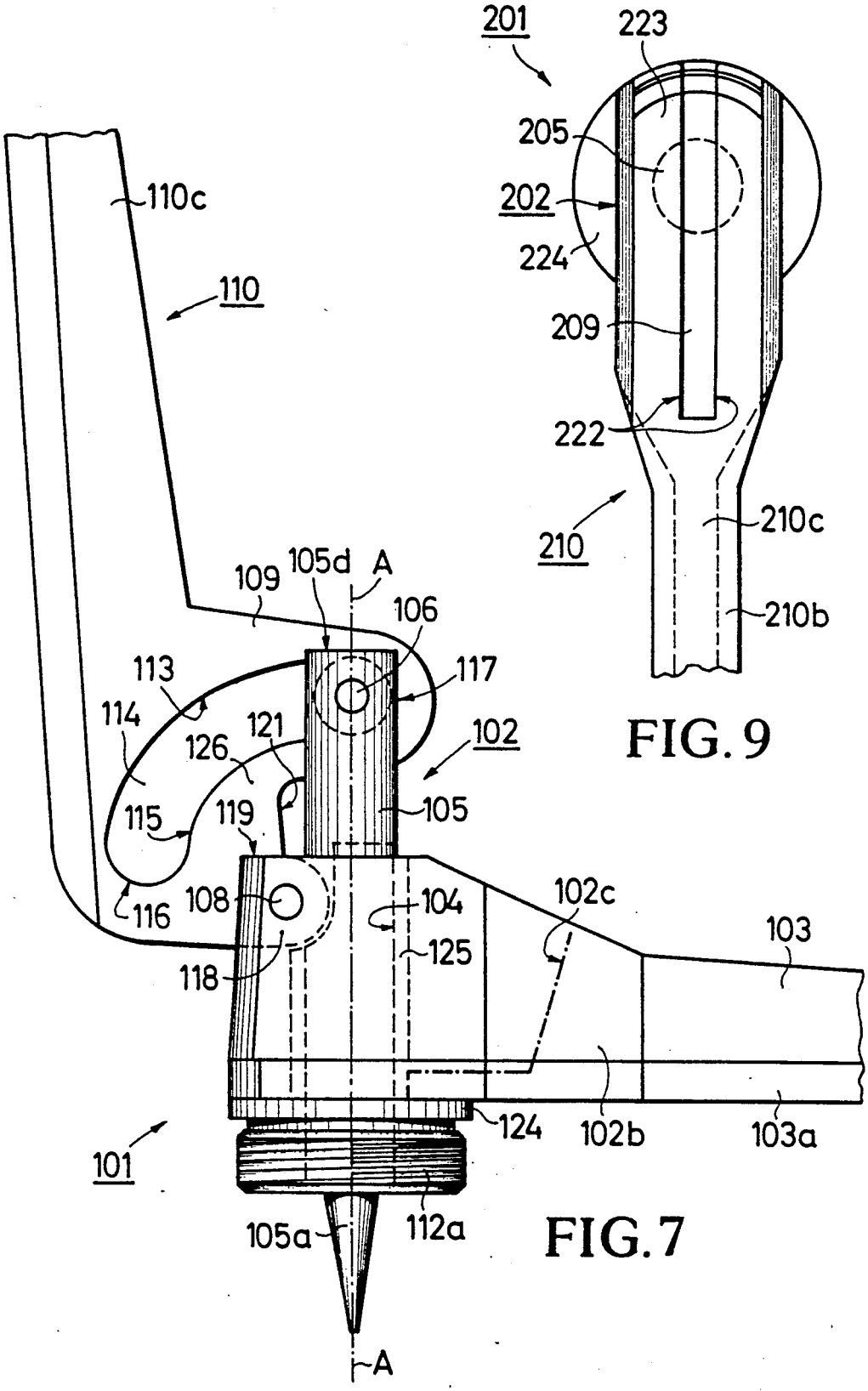
FIG. 7 is a lateral view of the object in FIG. 6, but before the beginning of the expanding procedure, i.e. with hand levers at a maximum distance.

FIGS. 6 and 7 show expansion tool 101, which has a basic tool body 102 of steel with a first, rigidly mounted hand lever 103 also made of steel, a borehole 104, and an expanding mandrel 105 with a tapered exterior end 105*a* which protrudes from the borehole, and is placed in the borehole in an axially sliding position. In the opposite end of the expanding mandrel 105, which also protrudes from the basic tool body 102, a free rotating cylinder 107 is placed by means of a cylindrical roller axis 106, whose pivot is perpendicular to the axis of the mandrel.

The basic tool body 102 has an adapter 102*a* in which the expanding mandrel is placed, and which has the approximate shape of a square with rounded corners and edges. The expanding mandrel 105 protrudes with the cylinder 107 in a upward direction from the adapter 102*a*. Between the adapter 102*a*, and the rigid hand lever 103 made of one piece, which has a T-shaped cross section with a flange 103*a* placed below, is a transition piece 102*b* with the corresponding bevelled wall surfaces to prevent gradations and kinks (the design corresponds approximately to that according to FIG. 9). The adapter 102*a* and the transition piece 102*b* have a slit shaped recess 102*c* which opens towards the top, and is represented with the dash-dot line, into which the control mechanism 109, described in more detail below, can be introduced (FIG. 6).

The swivelling control mechanism 109 which acts on the cylinder 107, is also placed in the basic tool body 102 by means of a swivel pin 108; the control mechanism is connected, forming one piece, to a second swivelling hand lever 110, which also has a T-shaped cross section, in this case with the flange 110*b* located on the top.

The control mechanism 109 and the crosspiece 110*c* have the same thickness. Through the control mechanism 109, the expanding mandrel 105 can be moved into the position according to FIG. 6 by clockwise rotating the second hand levers. The mandrel emerges from the basic tool body at a preset stroke, and moves against a set of radially movable expanding wedges 112, which can be connected to the basic tool body, and which are placed in a threaded sleeve. The threaded sleeve 112 together with the expanding wedges 111 can be screwed to a counterthread 112*a*, which is placed concentrically to the expanding mandrel 105 on the underside of the adapter 102*a*. The parts 111 and 112, also called expanding head, and their operation are prior art, therefore a more detailed explanation is not required.

The description "above" and "below" refer to the position shown in the figures.

The cylinder pin 106 has a noticeably smaller diameter than the cylinder 107 and its rolling surface 107*a*, which during the work procedure rolls on the first cam 113 of the control mechanism. By means of the cylinder pin 106, the cylinder 107 is placed in the same fashion as shown in FIGS. 1 and 4 in and between the two side walls 105*b* and 105*c*having parallel inside surfaces in the expanding mandrel, i.e. in a channel.

The control mechanism 109 has a slot 114 which spans from one side to the other, running in a curve around the swivel pin 108, and which is limited on one side by the first cam 113, and on the opposite side by the second cam 115. The inner width of the slot 114 corresponds at each point to the diameter of the cylinder 107 (plus a small play), so that the cylinder 107 is enclosed in the slot 114, and is mechanically guided in the two directions of the expanding mandrel, with the cam 113 causing the expanding procedure, and the cam 115 which encloses the cylinder 107 from behind, bringing about the enforced withdrawal. The withdrawal device 126 is formed by a part of the control mechanism 109 which supports the cam 115.

In the area of the cams 113 and 115, the control mechanism 109 fits into the channel between the side walls 105*b* and 105*c* of the expanding mandrel with little play, so that a twisting of the mandrel between the two side walls is prevented.

Both half cylindrical-concave shaped ends 116 and 117 of the curved slot 114 are connected to each other by the cams 113 and 115, and their center of curvature which in both possible end positions coincide alternatively with the axis of the cylinder 107, are at different distances from the swivel pin 108, in accordance with the stroke of the expanding mandrel 5. The course of the curve is monotonous, i.e. no position of the expanding mandrel is passed twice during the swinging of the control mechanism in one direction.

The ends 116 and 117 form stops limiting the angle of traverse of the swivelling hand lever 110, in which one stop (end 116) limits the proximity of the hand levers to a minimum distance in order to avoid a crushing of the fingers (FIG. 6). The other stop (end 117) limits the opening movement of the hand lever in accordance with FIG. 7.

The curved slot 114 has such a course in relation to the swivel axis 108 of the control mechanism 109 and to the cylinder 107, that the operating force used on the movable hand lever 110 remains essentially constant over the last 20 degrees of the angle of traverse of the hand lever.

The control mechanism 109 forms one end of the swivelling hand lever 110 made of forged steel, and has an eyelet for the placing of the swivel pin 108. The latter penetrates a channel 119 in the basic tool body 102, and is placed in same laterally, outside of the expanding mandrel 105 on the side opposite the hand levers 103 and 110, on both sides of the channel 119.

In order to prevent any hindrance between the eyelet 118 and the expanding mandrel 105, the latter has a milled recess 120 on one side in an extension of the channel between the side walls 105*b* and 105*c*. One can also see that the swivel pin 108 is clearly closer to the counterthread 112*a* than the pin 7 in the construction according to FIGS. 1 to 4.

Because of the slot 114, the part of the control mechanism 109 facing the swivel pin 108 forms a bend, which could also be called a crank which supports the cam 115. In order to maintain to a large extent the full cross section of the expanding mandrel, the control mechanism 109 has a recess 121 on the side of the eyelet 118 (FIG. 7), so that the lower edge of the control mechanism 109 practically wraps itself around the expanding mandrel in the final position, as seen in FIG. 6.

It is quite baffling that although the swivel pin 108 is traversed in relation to the pin 106 of the expanding mandrel 105, no disturbing transverse forces act on the expanding mandrel, which could cause the expanding mandrel to slow down.

FIG. 9 shows another form of construction 201. In this case the control mechanism 209 consists of a plate shaped piece - also, made of steel—and rigidly mounted in a parallel walled channel 222 of the movable hand lever 210*a*. This hand lever has the shape of a housing 223 located in the expanding mandrel 205, which in FIG. 9 covers the basic tool body, and also—in a lateral view which is not shown—encloses the expanding mandrel 205 and the cylinder, thus also covering them. The basic tool body and both hand levers (of which only 210 is visible) in this case consist of a light alloy, which results in a considerable weight reduction.

The counter thread 112*a* is placed in this case on the outer surface of a coupling piece 224, which is connected to the basic tool body with a hollow cylindrical extension. For clarification we refer to FIG. 7 in which this extension 125 is shown in a dash line in order to characterize its geometry and its position. The coupling piece 224 and the extension 125 which form one single piece and are made of steel, have a borehole that passes through, and which forms the axial guide for the expanding mandrel 105 and 205. It is understood that in case of a basic tool body made of steel, the use of parts 224 and 125 is not necessary.

Also the position of the swivel axis 108 in a plane underneath of a plane placed across the cylinder axis 106 (both planes perpendicular to the mandrel axis A—A), i.e. between any possible position of the cylinder axis 106 and the tapered end 105*a* of the expanding mandrel 105 is of special importance in view of the compact construction of the object of the invention. This makes a prolongation of the basic tool body 102 in the direction of the axis A—A upwards and beyond the end of the expanding mandrel unnecessary.

I claim:

1. Expansion tool for hollow working parts, said tool comprising a basic tool body having a borehole with a central axis and a first hand lever fixed thereto, an expanding mandrel placed in an axially sliding position in said borehole, said mandrel having an exterior tapered end protruding from said borehole and an inner end with two parallel sidewalls defining a channel therebetween, a freely rotatable member having a cylindrical surface located in said channel and journaled on a cylinder pin placed in said sidewalls, said pin having an axis which is perpendicular to the central axis of the borehole, a control mechanism mounted for rotation about a swivel pin in said tool body and having a second hand lever fixed thereto, said mechanism acting on said cylindrical surface to move said mandrel through a preset stroke when said first and second hand levers are moved relative to each other, a set of radially movable expanding wedges connected to the basic tool body and acted upon by said exterior tapered end of said mandrel when said mandrel moves through said stroke, and a withdrawal device which connects the mandrel to the second hand lever.

2. Expansion tool according to claim 1 wherein the control mechanism comprises a cam rotatable about said swivel pin and the withdrawal device comprises a tension member with working points on the freely rotatable member, and on the second hand lever.

3. Expansion tool according to claim 2 wherein the working point on the second hand lever is set eccentrically to the swivel pin and the tension member consists of a rigid tongue having one end which is placed in play in the longitudinal direction of the tongue by means of a tongue pin in a recess in the cam and having an opposite end which encircles the freely rotatable member.

4. Expansion tool according to claim 3 wherein the recess is set in the middle of the cam and has parallel side walls which closely receives the one end of the tongue, and opposite end of the tongue has a cylindrical borehole which encircles the cylinder, the tongue has an extension on the opposite side of the borehole and the mandrel has a recess in the base of said channel, which recess closely receives said extension to center said extension on the axial middle of the cylinder.

5. Expansion tool according to claim 1 wherein swivel pin and the cylinder pin intersect the borehole axis.

6. Expansion tool according to claim 1 wherein the control mechanism comprises a cam with such a course, that the operating force on the hand lever essentially remains constant over at least the last 20 degrees of the angle of traverse of the second hand lever.

7. Expansion tool according to claim 1 wherein the control mechanism comprises a cam surface formed as one wall of a slot, and the withdrawal device comprises a cam surface formed as the opposite wall of said slot.

8. Expansion tool according to claim 7 wherein said slot is curved about the swivel pin and has opposite ends at different distances from the swivel pin in accordance with the stroke of the expanding mandrel, the width of the slot corresponding to the diameter of the freely rotating member and guiding the movement of the expanding mandrel in both directions, the control mechanism being at least in part guided between the two side walls of the expanding mandrel.

9. Expansion tool according to claim 8 wherein the ends of the slot form stops which limit the angle of traverse of the hand levers.

10. Expansion tool according to claim 8 wherein the slot has such a course with respect to the swivel pin of the control mechanism and the cylinder, that the operating force on the second hand lever is essentially constant over at least the last 20 degrees of the angle of traverse of the hand lever.

11. Expansion tool according to claim 8 wherein the inner end of the expanding mandrel protrudes from the basic tool body.

12. Expansion tool according to claim 8 wherein the control mechanism forms one end of the second hand lever, and has an eyelet through which said swivel pin passes, which pin penetrates a channel in the basic tool body, and is placed in same laterally, outside of the expanding mandrel opposite the hand levers on both sides of the channel in the basic tool body.

13. Expansion tool according to claim 8 wherein the swivel pin is set on a first plane located between a second plane, in which the cylinder pin runs in any possible position, and the tapered end of the expanding mandrel, where both planes run perpendicularly to the central axis.

14. Expansion tool according to claim 8 wherein the control mechanism is in the form of a plate and is fixed in a parallel walled slot of the movable hand lever.

15. Expansion tool according to claim 8 wherein the basic tool body and both hand levers are made of light alloy, and the control mechanism is made of steel.

16. Expansion tool as in claim 15 wherein the basic tool body comprises a coupling piece having a hollow cylindrical extension which is coaxially received in the borehole of the basic tool body, said coupling piece having an external thread concentric to the expanding mandrel, said set of expanding wedges comprising a threaded sleeve screwed onto the external thread of said coupling piece.

* * * * *